US006183269B1

(12) United States Patent
Sarkissian et al.

(10) Patent No.: US 6,183,269 B1
(45) Date of Patent: Feb. 6, 2001

(54) TERMINATION ADAPTOR FOR PCB

(75) Inventors: Vicken Roben Sarkissian, Irvine; James Stanley Moore, Aliso Viejo, both of CA (US)

(73) Assignee: ITT Manufacturing Enterprises, Inc., Wilmington, DE (US)

( * ) Notice: Under 35 U.S.C. 154(b), the term of this patent shall be extended for 0 days.

(21) Appl. No.: 09/492,222

(22) Filed: Jan. 27, 2000

(51) Int. Cl.[7] ..... H01R 12/00
(52) U.S. Cl. ..... 439/76.1; 439/66
(58) Field of Search ..... 439/76.1, 74, 66, 439/83, 81, 284, 285

(56) References Cited

U.S. PATENT DOCUMENTS

| | | | | |
|---|---|---|---|---|
| 3,594,698 | | 7/1971 | Anhalt | 439/261 |
| 4,385,791 | | 5/1983 | Lovrenich | 439/83 |
| 4,396,242 | | 8/1983 | Kurano et al. | 439/581 |
| 4,585,284 | | 4/1986 | Koser et al. | 439/77 |
| 4,767,342 | * | 8/1988 | Sato | 439/83 |
| 4,830,622 | | 5/1989 | Erickson et al. | 439/70 |
| 4,881,902 | | 11/1989 | Papa et al. | 439/76 |
| 5,096,427 | | 3/1992 | Sadigh-Behzadi | 439/76 |
| 5,310,352 | | 5/1994 | Mroczowski et al. | 439/76 |
| 5,382,169 | | 1/1995 | Bailey et al. | 439/76 |
| 5,383,800 | * | 1/1995 | Saka et al. | 439/76.2 |
| 5,718,592 | * | 2/1998 | Hosler, Sr. et al. | 439/83 |
| 5,733,133 | | 3/1998 | Matsumura | 439/82 |
| 5,752,840 | | 5/1998 | Wu et al. | 439/76.1 |
| 5,764,487 | * | 6/1998 | Natsumi | 439/76.2 |
| 5,823,798 | * | 10/1998 | Zintler et al. | 439/76.2 |

* cited by examiner

*Primary Examiner*—T. C. Patel
(74) *Attorney, Agent, or Firm*—Thomas L. Peterson

(57) ABSTRACT

Apparatus is provided for terminating a connector (12) to a circuit board (16) by coupling multiple contacts (28) of the connector to multiple areas of the circuit board, which leaves one face (52) of the circuit board free of holes so surface mount circuit components (22) can be mounted on that face of the circuit board. A termination adaptor (14) is provided that includes an insulative frame (64) with multiple through passages extending between its opposite faces, and multiple intercontacts (62) each lying in one of the passages. Each intercontact has a resilient beam (76) that projects slightly beyond a first face (70) of the termination frame, so when the termination frame is pressed against first face of the circuit board that has traces (80) on it, the beams resiliently press against the traces. Second ends (74) of the intercontacts form clamps that receive projecting ends or tails (30) of the contacts of the connector and clamp to them. The assembly avoids the need for solder connections.

8 Claims, 5 Drawing Sheets

FIG. 6
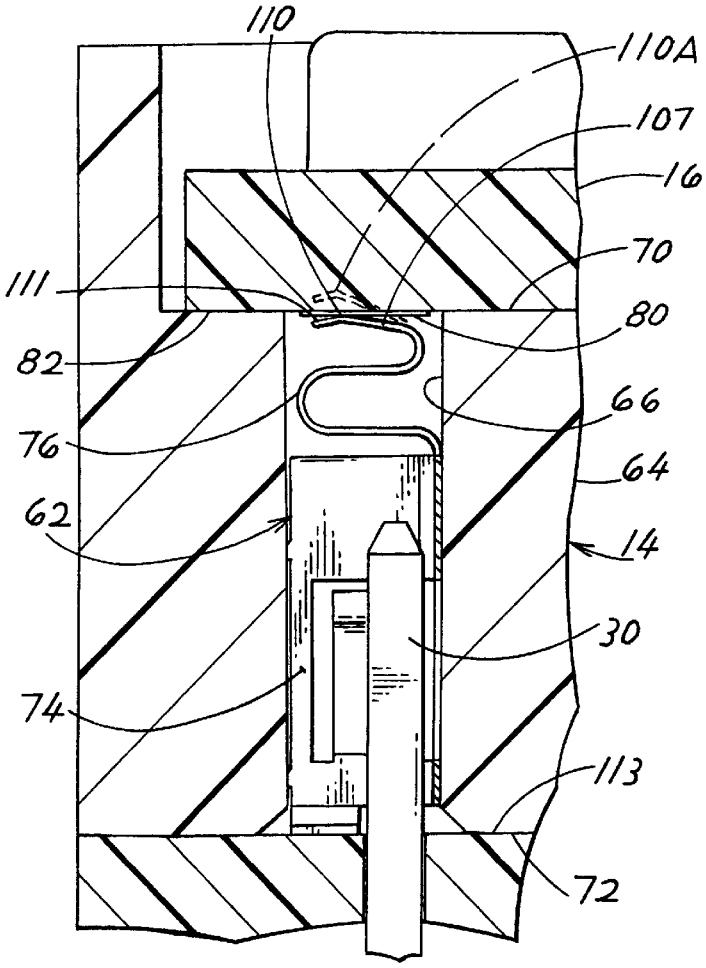
FIG. 5
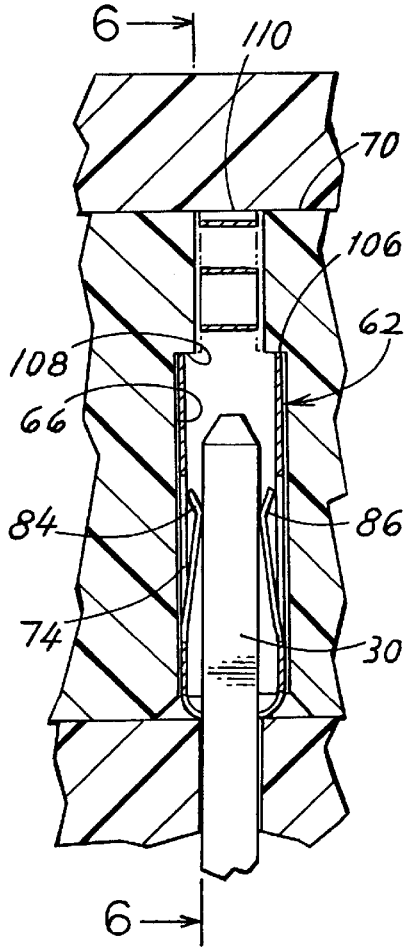
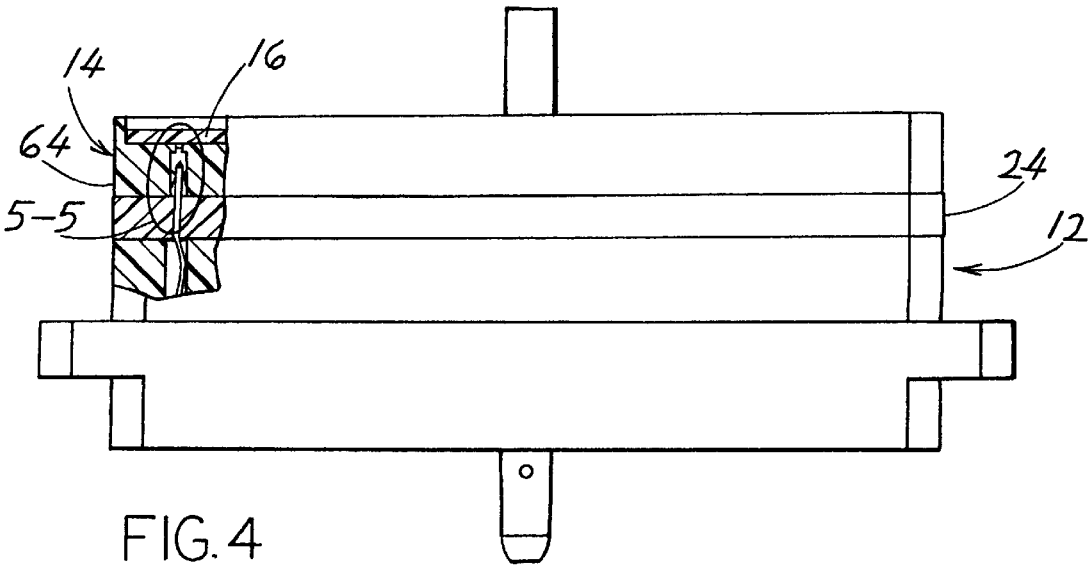
FIG. 4

FIG. 7
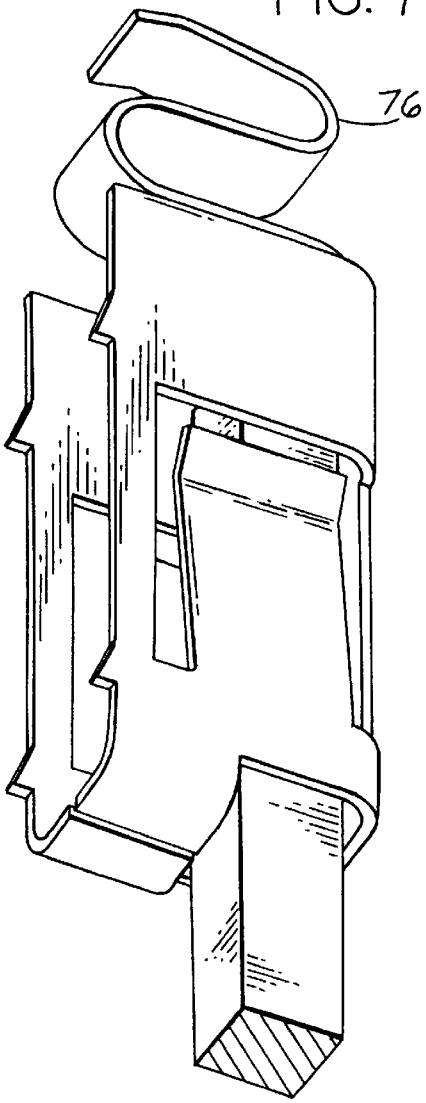
FIG. 8
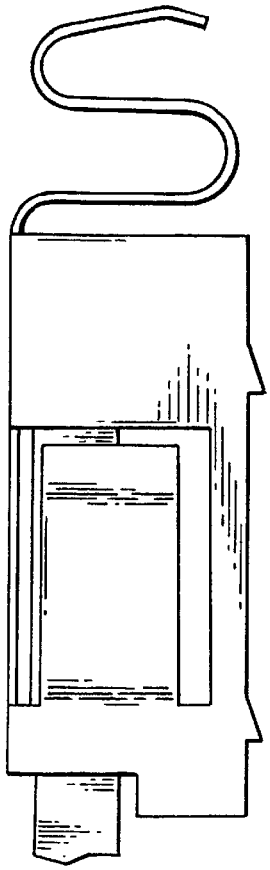
FIG. 9
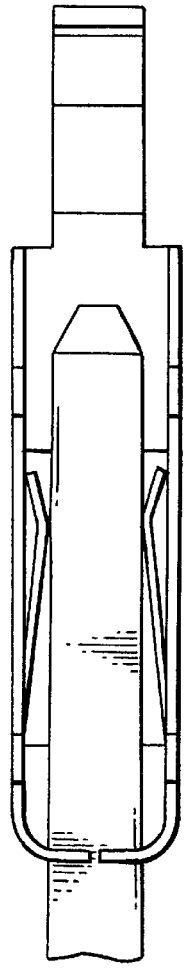
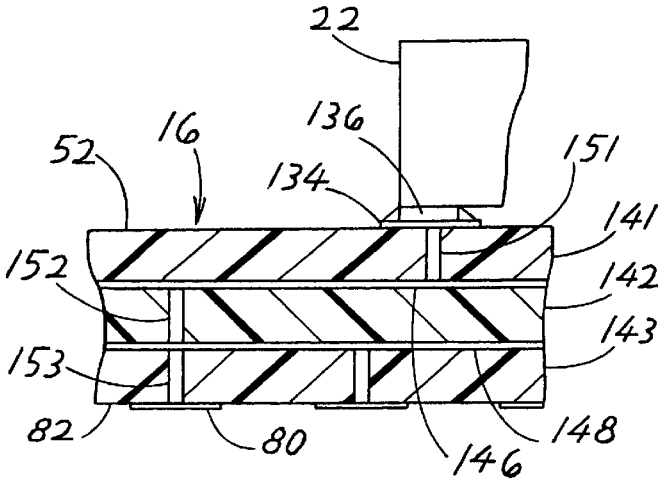
FIG. 10

FIG. 11
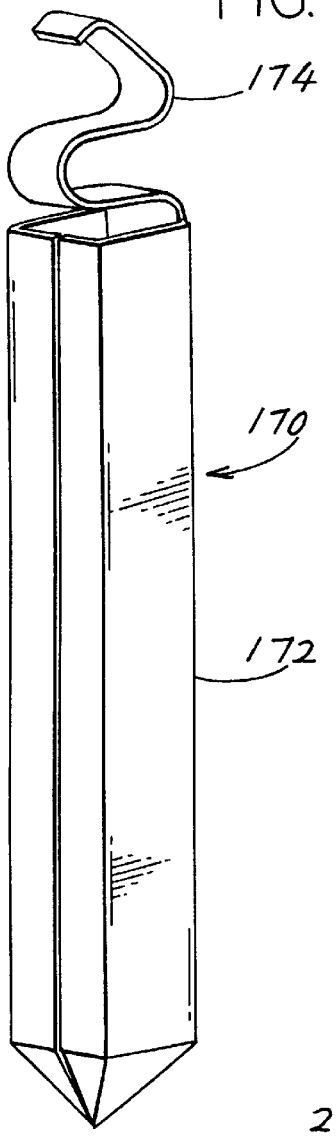
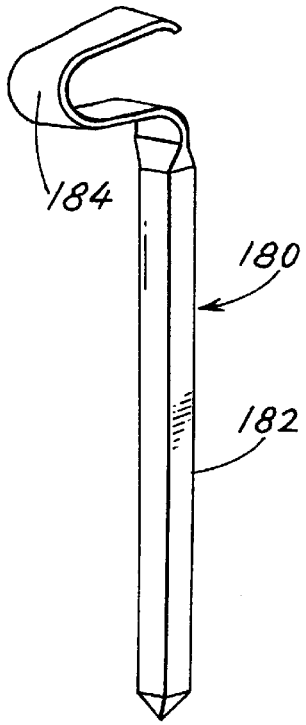
FIG. 12
FIG. 14
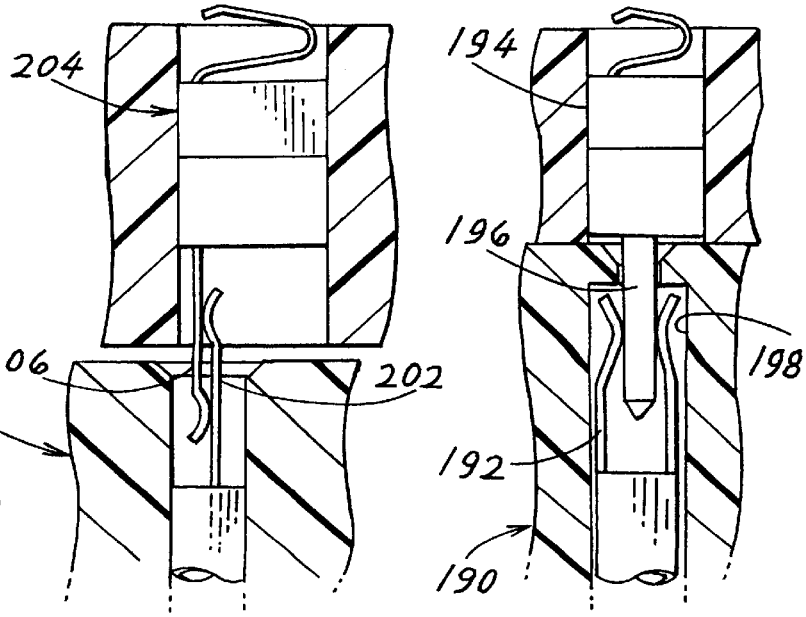
FIG. 13

TERMINATION ADAPTOR FOR PCB

BACKGROUND OF THE INVENTION

In many applications, the multiple contacts of a connector must be terminated to locations on a circuit board that holds circuit components. The most direct approach is to provide plated holes in the circuit board, insert pinlike contact tails into the holes, and solder the pins in the holes. Perhaps the greatest disadvantage of this approach is that the multiple pins and holes occupy a considerable area of the circuit board, and circuit components cannot be mounted there. Another disadvantage is that this approach usually requires reflow soldering to solder the pins in place, and the soldering not only adds cost but can damage solder joints where components are already soldered to the circuit board. It has been suggested to form holes only part way through the circuit board, but plating such blind holes is difficult and expensive. A system for connecting multiple contacts of a connector to multiple locations on a circuit board, which was simple and of low cost, and which avoided holes in one face of the circuit board so circuit components could be mounted thereon, would be of value.

SUMMARY OF THE INVENTION

In accordance with one embodiment of the present invention, apparatus is provided that includes a connector with contacts and a circuit board with locations that are to be connected to the contacts, which enables connection of the contacts and circuit board locations in a low cost manner that facilitates use of one face of the circuit board to hold circuit components. Both the upper and lower faces of the circuit board are provided with conductive traces. Circuit components such as integrated circuits, capacitors, inductors, and resistors, of the surface mount type, have their terminals soldered to traces on the upper face of the board. The traces on the lower surface are connected to the connector contacts through intercontacts. The intercontacts can be separate elements with lower ends connected to the contact ends and upper ends forming resilient beams for pressing against the traces. As a circuit board is mounted in place, its traces downwardly deflect the resilient beams of the intercontacts to establish reliable contact with them.

In one system, the intercontacts lie in passages of an intercontact frame that is sandwiched between the circuit board and connector. The connector contacts have projecting pin-like tails that project into the passages of the intercontact frame. Lower ends of the intercontacts have clamps that to automatically clamp to the contact tails. The connection of the intercontacts with the contact tails and with the circuit board traces do not require solder connections. This reduces the cost of assembling the intercontacts to the connector and circuit board, and avoids heating the circuit board with soldered components already in place thereon.

The novel features of the invention are set forth with particularity in the appended claims. The invention will be best understood from the following description when read in conjunction with the accompanying drawings.

BRIEF DESCRIPTION OF THE DRAWINGS

FIG. 4 is a partially sectional side view of the connector assembly of FIG. 1.

FIG. 5 is an enlarged view of area 5—5 of FIG. 4.

FIG. 6 is a view taken on line 6—6 of FIG. 5.

FIG. 7 is a bottom isometric view of one of the interconnectors of FIG. 3, and showing a contact tail engaged therewith.

FIG. 8 is a side elevation view of the intercontact and a portion of the contact tail of FIG. 7.

FIG. 9 is a right side elevation view of the intercontact and contact tail of FIG. 8.

FIG. 10 is a partial sectional view of the circuit board of FIG. 1, showing a circuit component mounted thereon.

FIG. 11 is an isometric view of a combined contact-and-intercontact, in accordance with another embodiment of the invention.

FIG. 12 is an isometric view of a combined contact-and-intercontact of another embodiment of the invention.

FIG. 13 is a sectional view showing an intercontact of another embodiment of the invention.

FIG. 14 is a sectional view showing an intercontact of still another embodiment of the invention.

DESCRIPTION OF THE PREFERRED EMBODIMENTS

Figure 2:
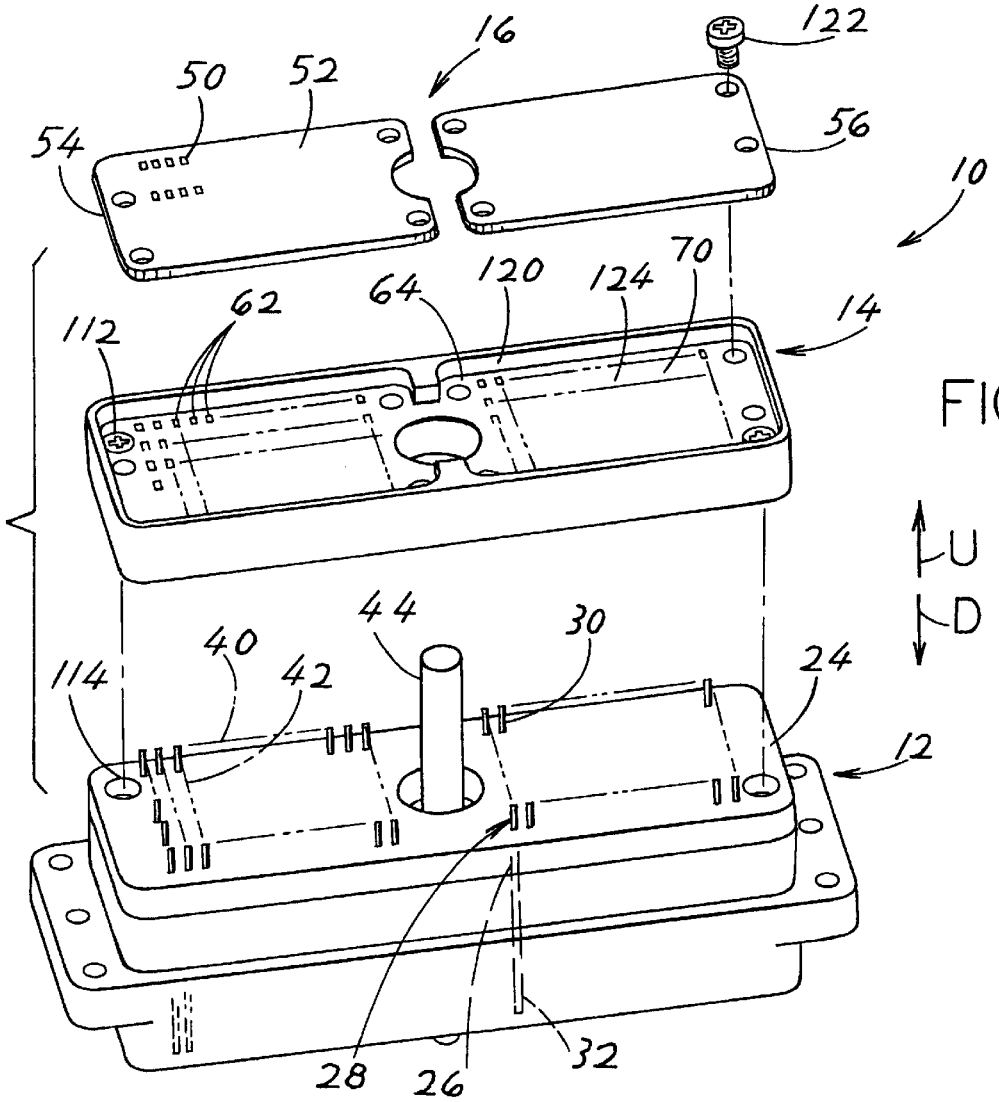
FIG. 2 is an exploded isometric view of the connector assembly of FIG. 1.
Figure 1:
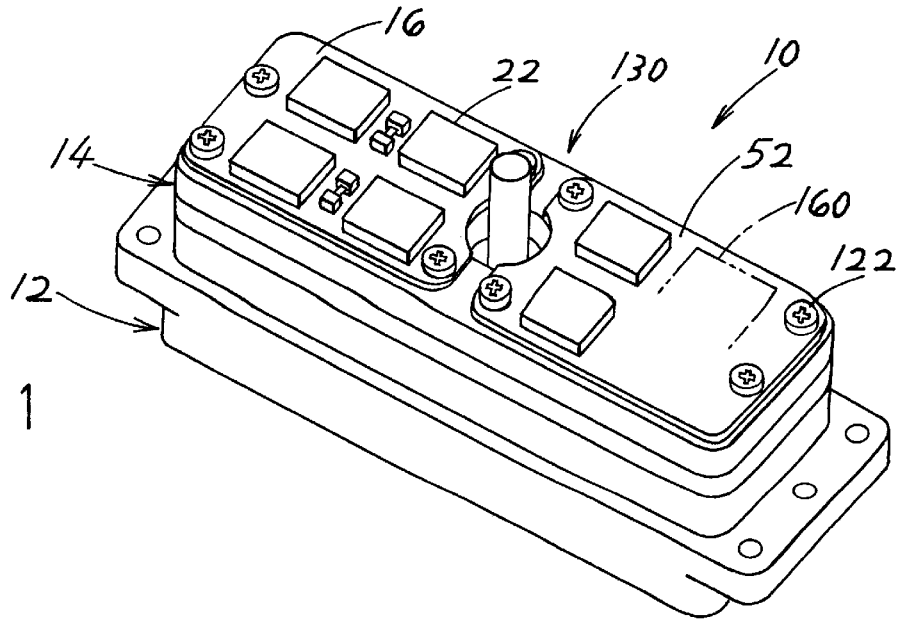
FIG. 1 is a top isometric view of a connector assembly of one embodiment of the present invention.

FIG. 1 illustrates a connector assembly 10 which includes a connector 12, a termination adaptor 14, and a circuit board 16. The circuit board has an upper face 52 with traces thereon that are soldered to terminals of electrical components 22. Electrical components are integrated circuits, capacitors, inductors, and resistors, that significantly alter electrical signals and that are usually represented by a symbol on a schematic diagram (other than by a simple line). As shown in FIG. 2, the electrical connector includes an insulator 24 with numerous passages 26, and also includes numerous contacts 28 mounted in the passages. Each contact has an upstanding or projecting contact part which can be referred to as a tail 30. The lower end 32 of each contact is mateable to another contact of another connector. Although the opposite ends of the contacts are usually vertically spaced, it should be noted that some contacts have an L-shape, where the contacts are bent 90° C. The contacts 28 are arranged in multiple rows 40 and columns 42. The particular connector shown is a type manufactured by applicant, which has 260 contacts arranged in two groups on opposite sides of a center rod 44. In that example, each group has ten rows 40 and thirteen columns 42. Many of the contact tails are intended to be connected to selected traces 50 on the upper face 52 of the circuit board. The circuit components shown in FIG. 1 at 22, have terminals that are soldered to the traces 50. It may be noted that the circuit board 20 is shown split into two circuit board parts 54, 56.

In accordance with the present invention, applicant provides the termination adaptor 14 which has a plurality of intercontacts 62. Each intercontact connects one of the contact tails 30 of the connector contacts to a corresponding location on the circuit board 16. As shown in FIG. 6, the termination adaptor 14 includes a dielectric termination frame, or intercontact frame 64 with numerous bores or passages 66 that extend between upper and lower ends 70, 72 of the frame. Each intercontact 62 has a lower or first part 74 that directly engages one of the contact tails 30 to make electrical connection therewith. Each intercontact also has an upper or second part 76 which is resiliently biased upwardly against an electrically conductive trace 80 on the lower face 82 of the circuit board. As shown in FIG. 5, the first part 74 of the intercontact forms a clamp that clamps to the contact tail 30. The clamp shown includes a pair of spring legs 84, 86 with at least one of them and preferably both being resiliently biased towards each other so both are deflected apart when the contact tail 30 is moved upwardly between them.

Figure 3:
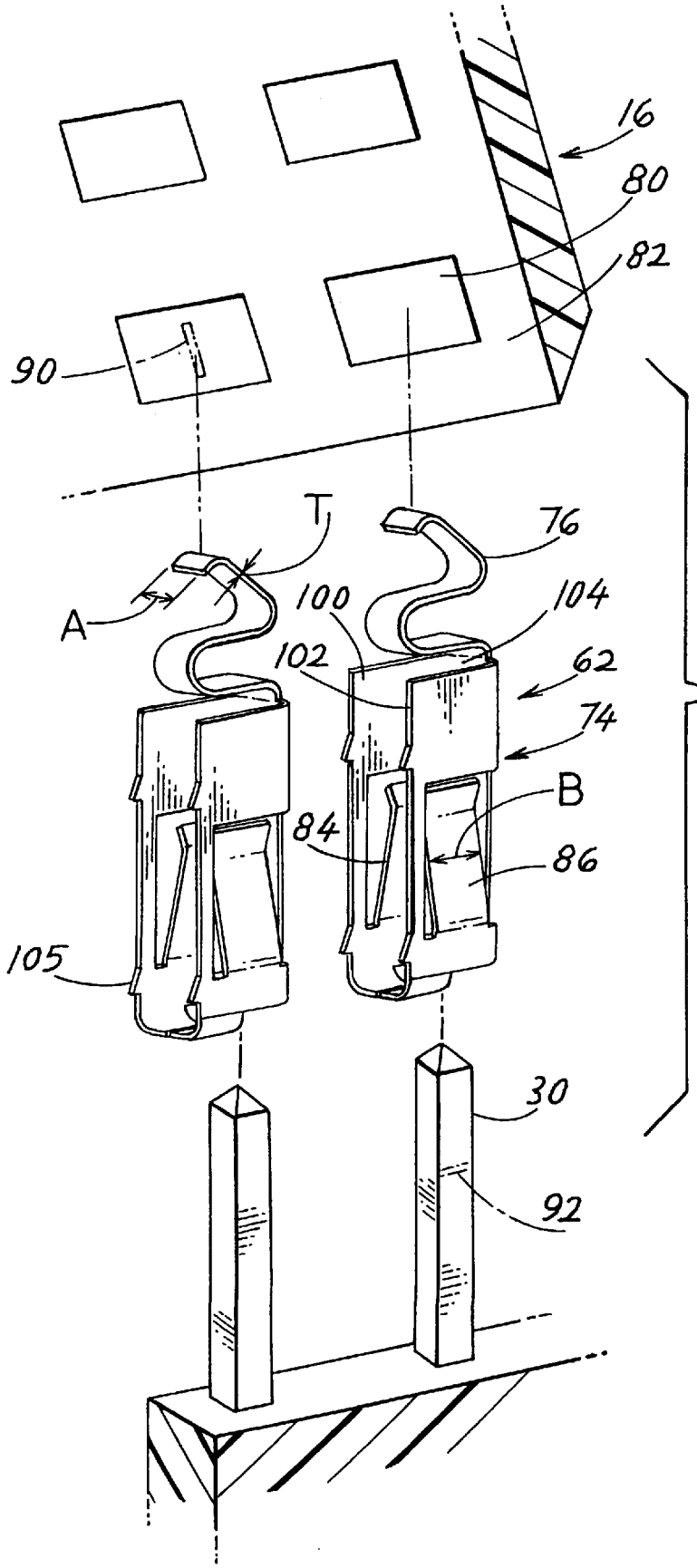
FIG. 3 is an exploded isometric view showing two intercontacts, two contact tails, and a portion of a circuit board of the connector of FIG. 2.

FIG. 3 shows that the traces 80 on the lower surface of the circuit board, are arranged in rows and columns corresponding to the positions of the contact tails 30. Each intercontact 62 is formed from a piece of sheet metal that has been cut and folded to the shape shown. The resilient second part 76 is in the form of a strip having a width A that is a plurality of times its thickness T. This strip is bent into a largely S-shape or a shape with two U-parts, to provide high resilience. The legs 84, 86 are also in the form of strips that each has a width B that is a plurality of times its thickness T. This construction results in engagement of the upper or second part 76 with a circuit board trace 80 along an elongated area or line contact area 90 on the trace. Similarly, each of the legs engages a contact tail along a wide area 92 of the contact tail. The lower or first part 74 of each intercontact is formed by folding a flat piece of sheet metal, into which the legs 84, 86 have been cut, into a U shape, with a pair of arms 100, 102 connected by a base 104. The second part 76 is a resilient beam that is an upward extension of the base 104. The arms have barbs 105 that form retention parts.

As shown in FIGS. 5 and 6, each intercontact 62 can be installed in the intercontact frame 64 by pushing it upwardly into one of the bores 66. The intercontact is pushed upward until retention parts in the form of edges 106 at the top of the lower part abut corresponding shoulders 108 formed in the bore. At this position, a contacting part 110 of the intercontact lies at the position 110A wherein it is slightly above the upper surface 70 of a plate-part of the intercontact frame. The circuit board 16 is then lowered into place so its traces engage the intercontacts. The upper and lower faces 70, 72 of the frame lies substantially facewise adjacent to the circuit board lower face 82 and to the connector insulator upper face 113. The contacting part is formed by a bend 110 at the upper end of a main part 107 of the resilient beam 76. A short extension 111 (less than half the height of the beam) on a side of the bend opposite the main part is free to deflect downwardly.

FIG. 2 shows that the connector assembly 10 can be assembled by moving the termination adaptor 14 downwardly onto the insulator 24 of the connector 12, so the contact tails 30 project into bores of the intercontact frame 64 to engage the intercontacts 62. A pair of screws 112 are shown that enter threaded holes 114 in the connector to securely mount the adaptor 14 to the connector. The parts 54, 56 of the circuit board 16 can then be lowered within a rim 120 of the adaptor and fastened in place with several screws 122, to a plate-like portion 124 of the intercontact frame.

In commercial practice, the electrical connector 12 and adaptor 14 are provided by a manufacturer of large quantities of these items. The connector and adaptor are then sold to an assembly firm that constructs a circuit board assembly with components, such as shown at 130 in FIG. 1, and assembles the circuit board assembly to the adaptor and connector. The circuit board assembly 130 includes a circuit board 16 which is manufactured with numerous traces on its lower face that correspond with many if not all of the positions of the intercontacts 62 (FIG. 2). The upper face of the circuit board is provided with traces at positions where the terminals of circuit components will be mounted. The circuit components 22 are then mounted on traces at the upper surface of the circuit board by soldering. As discussed above, the circuit board is then ready to be assembled to the adaptor and connector and fastened by the screws 122.

FIG. 10 shows traces 80, 134 on the lower and upper faces 82, 52 of the circuit board 16. The figure also shows a terminal 136 of a circuit component 22 soldered to one of the traces 134 on the upper face. The particular circuit board illustrated has three layers 141, 142, 143, with a series of traces 146, 148 between layers. Each of the layers has holes filled with conductive material at 151, 152, 153 to interconnect selected traces on the bottom and top faces of the board. The use of a plurality of circuit board layers with holes containing conductors, is known in the prior art.

By manufacturing and assembling the components in the manner described above, the assembly firm can manufacture the circuit board assembly before assembling it. When the circuit board assembly is assembled to the adaptor and connector, additional soldering steps are not required. If, for example, the contact tails 30 or intercontact 62 had to be soldered to the circuit board, then this would require applying heat to the circuit board, which might damage solder connections already made on the upper face of the circuit board. The lower and upper traces 80, 134 on the lower and upper faces of the circuit board lie opposite each other, that is, a plurality of the upper traces 134 lie between pairs of lower traces 80, as would be seen in a plan view in which both lower and upper traces could be seen. As a result, where there is limited space available for holding the circuit components 22, as shown in FIG. 1, substantially the entire upper surface area of the circuit board is available to hold components. It may be noted that in addition to the circuit components, it is possible to provide a connector or header indicated at 160, although it is usual to fill the upper face of the circuit board with circuit components.

While applicant prefers to mount the intercontacts 62 within a frame 64, it should be noted that it is possible to mount individual intercontacts directly on the contact tails.

FIG. 11 shows a combination contact 170 which includes a contact portion 172 that can extend through an insulator and with its lower end forming a mating contact or forming a termination to a wire. An upper portion 174 forms a resilient beam that is biased against traces on a lower face of a circuit board. The particular combination contact 170 is shown formed of a piece of sheet metal that has been bent to the shape illustrated. FIG. 12 shows another combination contact 180 that is formed of a metal rod, with its lower portion 182 forming a contact that can lie in a connector insulator. The upper portion 184 is formed by flattening an upper portion of the rod to form the resilient beam.

FIG. 14 shows a connector 190 with socket contacts 192 whose tails do not project but which form sockets. An intercontact 194 has a pin portion 196 that extends downwardly into a bore 198 in the insulator of the connector, and into the socket to make electrical connection with the contact of the connector. FIG. 13 shows a connector 200 with contacts forming upwardly-projecting tails 202 that are designed to engage similarly-shaped tails. The intercontact 204 has a downwardly-extending pin portion 206 that engages the contact tail.

While terms such as "top", "bottom", etc. have been used to describe the invention and its parts as illustrated, it should be understood that the electrical to connector can be used in any orientation with respect the Earth.

Thus, the invention provides an electrical connector that includes a circuit board with circuit components thereon, where contacts of the electrical connector are easily coupled to the circuit components. The circuit board is provided with traces on its lower face which are connected to selected traces on its upper face, the circuit components being connected to the traces on the upper face. Intercontacts couple the connector contacts to the traces on the lower face of the circuit board, the intercontacts having beams that are spring loaded to provide resilient contact with the circuit board traces. Where the connector contacts have upwardly projecting rigid portions or tails, each intercontact has a portion such as a clamp for engaging the contact tail, with the upper portion of the intercontact being resiliently biased upwardly against the circuit board traces. Applicant prefers to construct each intercontact with a resilient beam that can be downwardly deflected. The resilient beam can be in the form of a wire that can even be a coil, although applicant prefers a strip. The invention permits the circuit board to be constructed with solder connections, and enables connection of the circuit board to the connector contacts in a simple manner that can be accomplished without soldering connections between the intercontacts and traces on the circuit board.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An apparatus for connecting a circuit board first face that has traces thereon, to contact ends of contacts of a connector, comprising:

an intercontact frame having a plate-shaped portion with upper and lower intercontact frame faces and a plurality of through passages extending between said faces;

a plurality of one-piece electrically conductive intercontacts, each mounted at a fixed position in one of said intercontact frame passages, with each intercontact having a lower portion that lies adjacent to said lower frame face and that is connectable to one of said contacts and having an upper end forming a resilient beam that projects above said upper frame face when said circuit board is not present and that is downwardly deflectable by said circuit board to a position substantially flush with said upper frame face.

2. An apparatus for connecting a circuit board first face that has traces thereon, to contacts of a connector, comprising:

an intercontact frame which has a plate-shaped portion with upper and lower intercontact frame faces and a plurality of through passages extending between said faces, with said passages having passage walls that are electrically isolated from each other;

a plurality of electrically conductive intercontacts, each having a vertical length and lying along a majority of its length in one of said intercontact frame passages, with each intercontact formed of a single piece of sheet metal and having an upper end forming a resilient beam that projects above said upper frame face when said circuit board is not present, with each intercontact having a lower portion that is integral with said upper end and that forms means for engaging a corresponding one of said contacts;

each resilient beam being downwardly deflectable to a position substantially flush with said upper intercontact frame face.

3. The apparatus described in claim 2 wherein:

said connector comprises an insulator having upper and lower faces;

said upper and lower faces of said intercontact frame lie respectively against said circuit board first face and said connector insulator upper face.

4. The apparatus described in claim 2 including said connector, and wherein:

said connector includes a connector insulator with an upper face, and said connector has a plurality of contacts lying primarily in said connector insulator and having contact upper ends forming tails projecting above said connector frame upper face and into one of said passages in said interconnect frame;

each of said intercontact lower portions lies in said intercontact frame and has a resilient spring leg that presses primarily horizontally against one of said tails that lies in the corresponding passage.

5. The apparatus described in claim 2 including said connector, and wherein:

said connector includes a connector insulator having a plurality of bores and having an upper face lying against said lower intercontact frame face, and said connector has a plurality of contacts lying primarily in said connector insulator and having upper ends forming sockets lying within said insulator bores;

each of said intercontact lower portions projects below said lower intercontact frame face into one of said insulator bores and engages one of said sockets.

6. The apparatus described in claim 2 wherein:

said intercontacts each have retention parts lying in one of said passages, that prevents the intercontact from moving upward or downward out of the corresponding passage.

7. A combination of a circuit board with a lower face having traces thereon, a connector with a connector insulator having an upper face and a plurality of bores and with contacts each lying in said one of bores, and apparatus for connecting each of a plurality of said contacts to each of a plurality of said traces comprising:

an intercontact frame having a plate-shaped portion with upper and lower frame faces and a plurality of through frame passages extending between said faces, said frame passages having passage walls that are electrically isolated from each other;

a plurality of intercontacts each lying primarily in one of said intercontact frame passages with said intercontacts having upper ends projecting slightly above the upper frame face and being downwardly deflectable to a position flush with the upper frame face, and with said intercontacts having lower parts each connected to one of said contacts;

said intercontact frame being sandwiched between said circuit board and said connector insulator with said upper and lower faces lying substantially facewise adjacent respectively to said circuit board lower face and to said connector frame upper face, with said intercontact upper ends pressing against but unfixed to said circuit board traces.

8. An apparatus for connecting traces on a lower face of a circuit board to contacts of a connector, comprising:

an intercontact frame having a plate-shaped portion with upper and lower frame faces and a plurality of through frame passages extending between said faces, said frame passages having passage walls that are electrically isolated from each other;

a plurality of intercontacts each lying primarily in one of said frame passages, with each intercontact formed of a single piece of sheet metal and having a lower part formed to connect to one of said contacts, and with each intercontact having an upper end forming a resilient beam with a major part that extends at an upward incline to the horizontal and that has a highest point, with each beam having a bend at said highest point, and with each beam having an extension on a side of said bend opposite said major part with said extension having a free end that is unrestrained from downward movement;

each of said intercontacts having its upper end projecting slightly above the upper frame face and unfixed to said circuit board and being downwardly deflectable to a position flush with the upper frame face.

* * * * *